US012123638B2

(12) United States Patent
Cooper et al.

(10) Patent No.: US 12,123,638 B2
(45) Date of Patent: Oct. 22, 2024

(54) REFRIGERATOR APPLIANCE

(71) Applicant: WHIRLPOOL CORPORATION, Benton Harbor, MI (US)

(72) Inventors: David Cooper, Dowagiac, MI (US); Mark Graff, Michigan City, IN (US); James Guarino, Kalamazoo, MI (US); Deepak Mankar, Pune (IN); Gowardhan Parikshit, Pune (IN); Ranjit Pandurang Patil, Pune (IN); Rohit Tendulkar, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 146 days.

(21) Appl. No.: 17/957,121

(22) Filed: Sep. 30, 2022

(65) Prior Publication Data

US 2024/0110743 A1 Apr. 4, 2024

(51) Int. Cl.
*F25D 23/12* (2006.01)
*F25D 23/02* (2006.01)

(52) U.S. Cl.
CPC ..... *F25D 23/028* (2013.01); *F25D 23/126* (2013.01); *F25D 2323/121* (2013.01)

(58) Field of Classification Search
CPC ..... F25D 23/028; F25D 23/126; F25D 2323/121; B01D 2201/4061; B01D 2201/4023; B01D 2201/4007; B01D 35/153; B01D 27/08; B01D 27/06
See application file for complete search history.

(56) References Cited

U.S. PATENT DOCUMENTS

| | | | | |
|---|---|---|---|---|
| 7,056,435 | B2 | 6/2006 | Jenkins et al. | |
| 7,442,301 | B2 | 10/2008 | Huda | |
| 8,020,403 | B2 | 9/2011 | Rotter et al. | |
| 8,627,675 | B2 | 1/2014 | Kruckenberg et al. | |
| 10,252,198 | B2 | 4/2019 | Staud et al. | |
| 10,807,025 | B2 | 10/2020 | Kapure | |
| 10,946,319 | B2 | 3/2021 | Subrahmanya et al. | |
| 2018/0318738 | A1 | 11/2018 | Chernov et al. | |
| 2020/0047095 | A1* | 2/2020 | Wei | B01D 35/30 |
| 2021/0299600 | A1 | 9/2021 | Lee et al. | |
| 2022/0024781 | A1 | 1/2022 | Keel et al. | |

FOREIGN PATENT DOCUMENTS

KR 20010081462 A 8/2001

* cited by examiner

*Primary Examiner* — Cassey D Bauer
(74) *Attorney, Agent, or Firm* — Brooks Kushman P.C.

(57) ABSTRACT

A refrigerator includes a filter, a receiver, a manifold, and a cam. The filter has a handle extending therefrom. The receiver defines a cavity configured to receive the filter. The manifold is configured to engage an opposing end of the filter relative to the handle via axial rotation of the filter. The manifold is configured to pivot upward to transition the filter to an activated position. The manifold is configured to pivot downward to transition the filter to a deactivated position. The cam is configured to interfere with the handle in response to partial axial rotation of the filter to prevent the filter from pivoting upward to the activated position. The cam is configured to provide clearance for the handle in response to full axial rotation of the filter to facilitate the filter pivoting upward to the activated position.

20 Claims, 9 Drawing Sheets

REFRIGERATOR APPLIANCE

TECHNICAL FIELD

The present disclosure relates to an appliance such as a refrigerator.

BACKGROUND

Refrigerator appliances may include systems that require a water supply. Such systems may be configured to produce ice cubes or to deliver water to a user via a dispensing device.

SUMMARY

A refrigerator includes a cabinet, a water system, a water filter, a receptacle, a fluid manifold, a cover, and a plate. The cabinet defines an internal cavity configured to receive foodstuffs. The water system is configured to deliver water from a source to a dispenser and an ice maker. The water filter is configured to purify the water within the water system. The water filter has a distal end, a proximal end, and a handle extending from the proximal end. The receptacle is disposed within the internal cavity and is configured to receive the water filter. The fluid manifold is pivotably secured to the receptacle, The fluid manifold is configured to engage the distal end of the water filter via axial rotation of the water filter relative to the fluid manifold to establish fluid communication between the water filter and the water system. The fluid manifold is configured to pivot upward to transition the water filter to an activated position. The fluid manifold is configured to pivot downward to transition the water filter to a deactivated position for replacement. The cover is pivotably secured to the receptacle. The cover is configured to pivot upward to a closed position to cover the water filter within the receptacle. The cover is configured to pivot downward to an open position to provide access to the water filter within the receptacle. The plate is disposed within the receptacle. The plate defines a cam profile. The cam profile is configured to interfere with the handle in response to partial axial rotation of the water filter relative to the fluid manifold such that the water filter cannot pivot upward to the activated position and such that the cover cannot pivot upward to the closed position. The cam profile is also configured to provide clearance for the handle in response to full axial rotation of the water filter relative to the fluid manifold such that the water filter can pivot upward to the activated position and such that the cover can pivot upward to the closed position.

A refrigerator includes a filter housing, a receptacle, a fluid manifold, a cover, and a cam plate. The filter housing has a handle extending therefrom. The receptacle is configured to receive the filter housing. The fluid manifold is configured to engage an opposing end of the filter housing relative to the handle via axial rotation of the filter housing relative to the fluid manifold. The fluid manifold is configured to pivot upward within the receptacle to transition the filter housing to an activated position. The fluid manifold is configured to pivot downward within the receptacle to transition the filter housing to a deactivated position. The cover is configured to pivot upward to a closed position to cover the filter housing within the receptacle. The cover is configured to pivot downward to an open position to provide access to the filter housing within the receptacle. The cam plate is disposed within the receptacle. The cam plate is configured to interfere with the handle in response to partial axial rotation of the filter housing relative to the fluid manifold such that the filter housing cannot pivot upward to the activated position and such that the cover cannot pivot upward to the closed position. The cam plate is configured to provide clearance for the handle in response to full axial rotation of the filter housing relative to the fluid manifold such that the filter housing can pivot upward to the activated position and such that the cover can pivot upward to the closed position.

A refrigerator includes a filter, a receiver, a manifold, and a cam. The filter has a protrusion extending therefrom. The receiver defines a cavity configured to receive the filter. The manifold is configured to engage an opposing end of the filter relative to the protrusion via axial rotation of the filter relative to the manifold. The manifold is configured to pivot upward within the receptacle to transition the filter to an activated position. The manifold is configured to pivot downward within the receptacle to transition the filter to a deactivated position. The cam is disposed within the cavity. The cam is configured to interfere with the protrusion in response to partial axial rotation of the filter relative to the manifold to prevent the filter from pivoting upward to the activated position. The cam is configured to provide clearance for the protrusion in response to full axial rotation of the filter relative to the manifold to facilitate the filter pivoting upward to the activated position.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
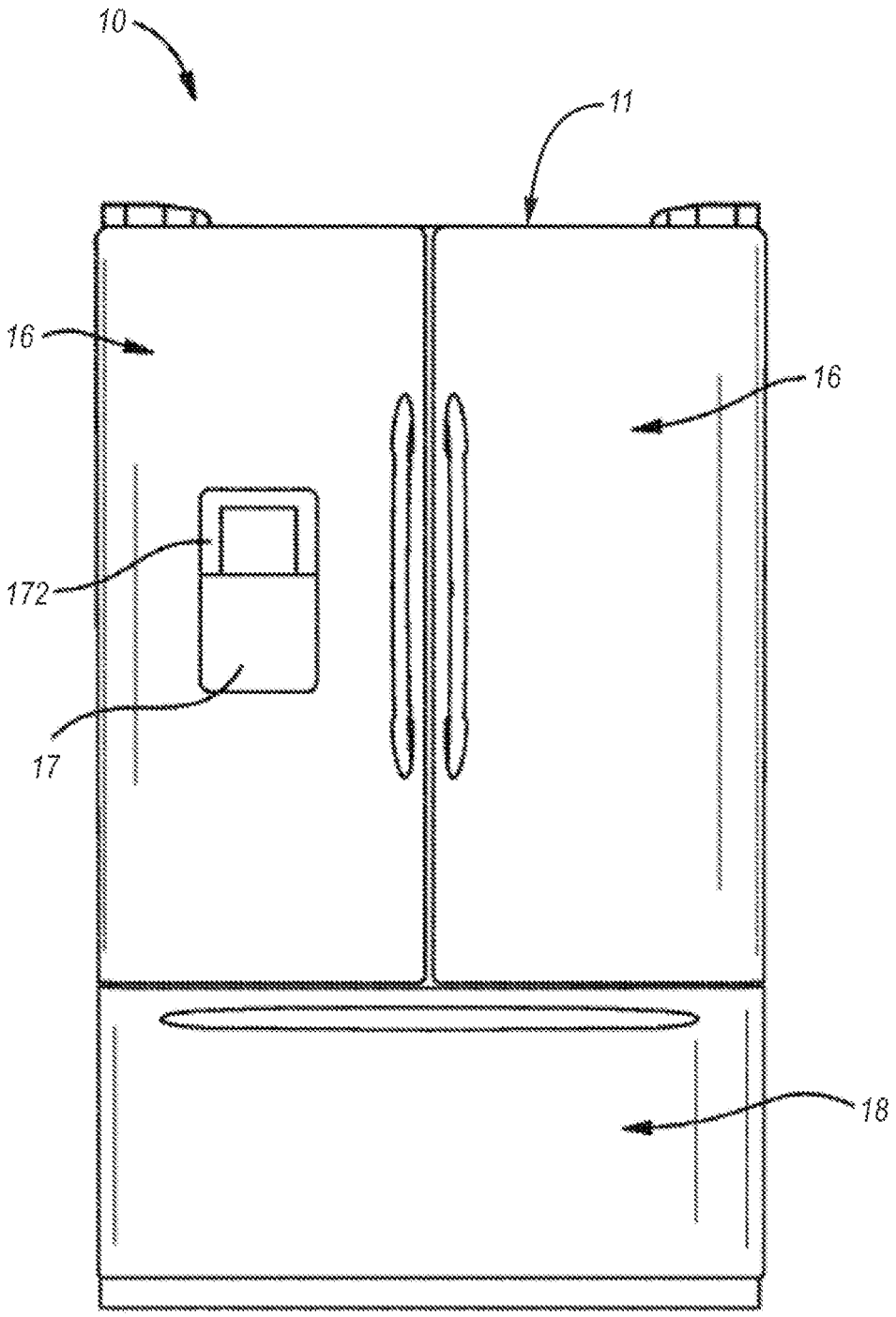
FIG. 1 is an elevated front view of a French-Door Bottom Mount type refrigerator appliance.

Referring to FIG. 1, reference numeral 10 generally designates a refrigerator with an automatic ice maker 20. As described below, an automatic ice maker is an ice maker either as a stand-alone appliance, or within another appliance such as a refrigerator, wherein the ice making process is typically induced, carried out, stopped, and the ice is harvested with substantially no user input.

Figure 2A:
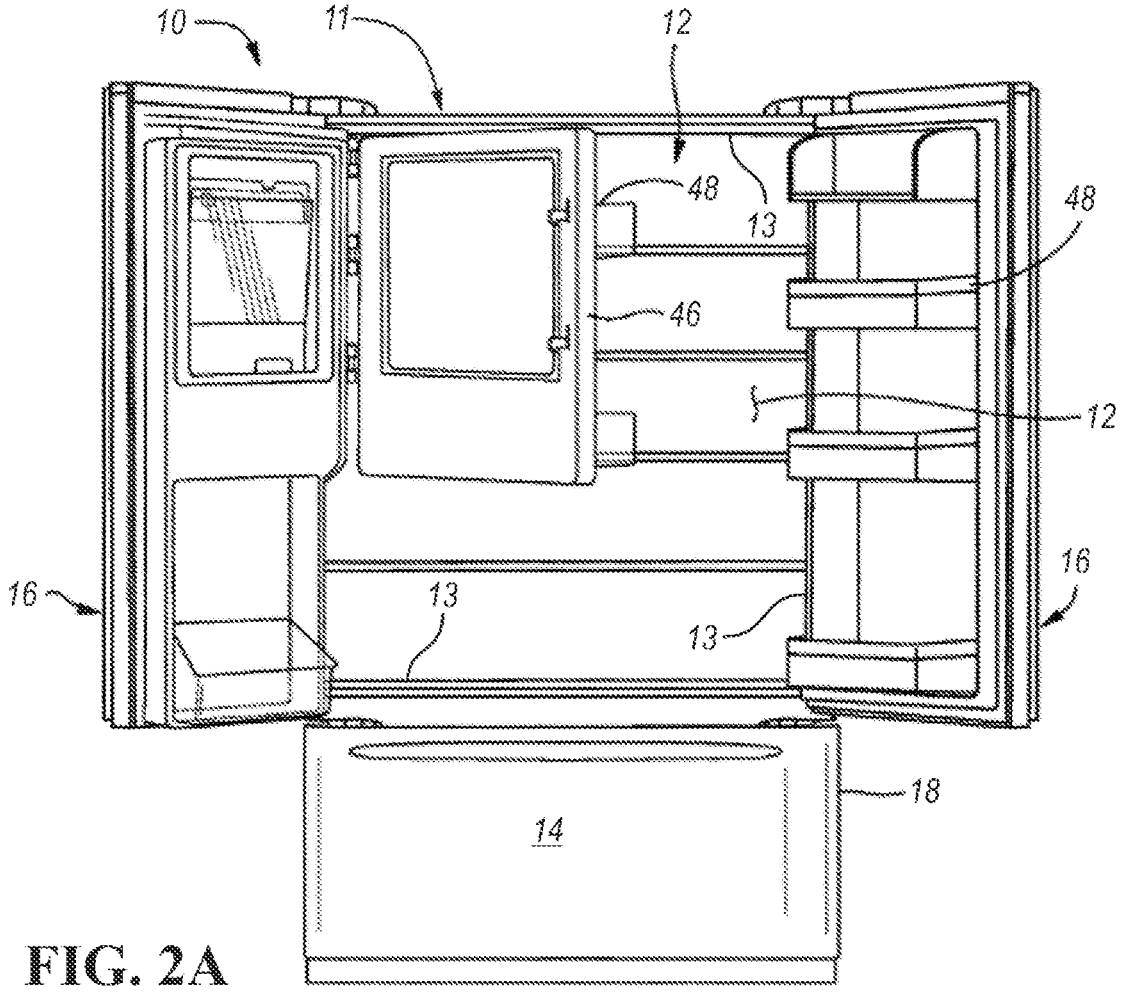
FIG. 2A is an elevated front view of a French-Door Bottom Mount type refrigerator with the refrigerator compartment doors open.
Figure 2B:
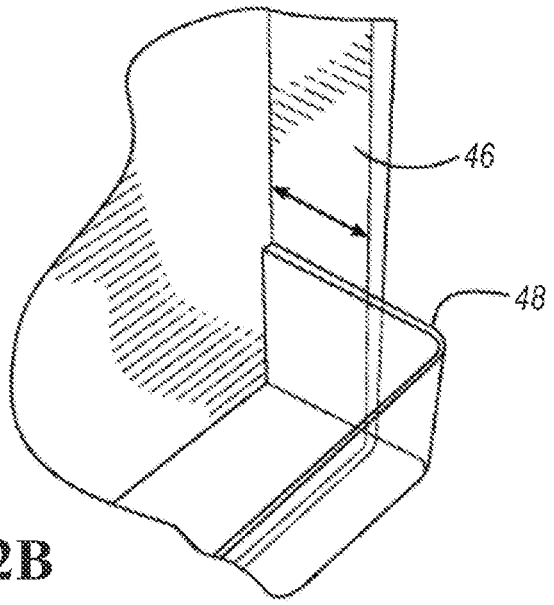
FIG. 2B is a perspective view of an aspect of an access door for the ice maker.

FIG. 1 generally shows a refrigerator 10 of the French-Door Bottom Mount type, but it is understood that this disclosure could apply to any type of refrigerator, such as a side-by-side, two-door bottom mount, or a top-mount type. As shown in FIGS. 1-2B, the refrigerator 10 may have a housing or cabinet 11 defining a first internal storage chamber, first internal cavity, or fresh food compartment 12 configured to refrigerate and not freeze consumables or foodstuffs within the fresh food compartment 12. The cabinet 11 may also define a second internal storage chamber, second internal cavity, or a freezer compartment 14 configured to freeze consumables or foodstuffs within the freezer compartment 14 during normal use. The cabinet 11 includes walls 13 that define the fresh food compartment 12 and the freezer compartment 14. The walls 13 may include both exterior panels and interior panels. The interior panels may form an inner liner. An insulating material, such as an insulating foam, may be disposed between the exterior panels and the interior panels. The refrigerator 10 may have one or more doors 16, 18 that provide selective access to the interior volume of the refrigerator 10 where consumables may be stored. As shown, the fresh food compartment doors are designated 16, and the freezer door is designated 18. It may also be shown that the fresh food compartment 12 may only have one door 16.

Figure 3:
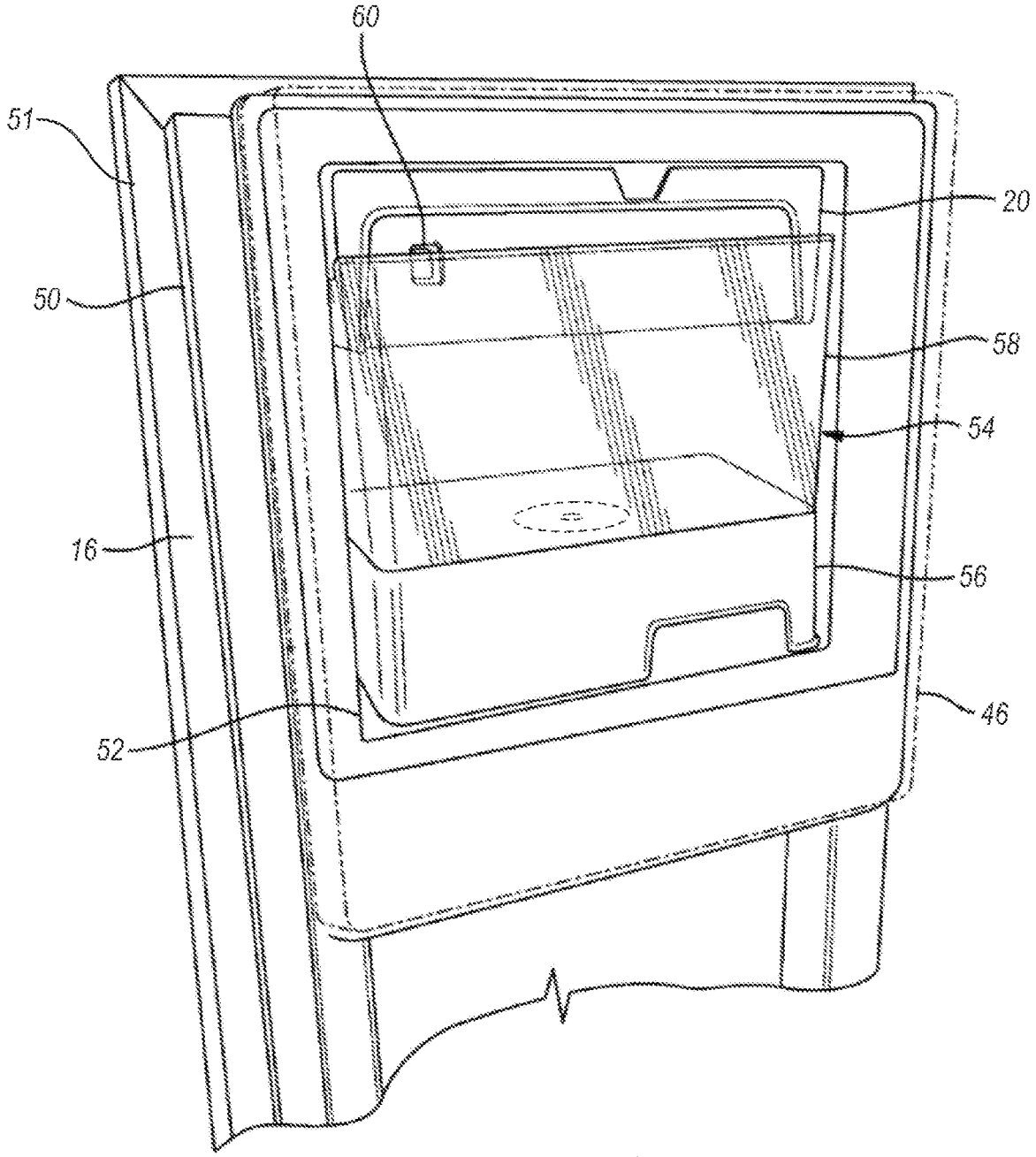
FIG. 3 is a perspective view of the interior of one door of the refrigerator compartment with the ice maker and ice container installed.

It is generally known that the freezer compartment 14 is typically kept at a temperature below the freezing point of water, and the fresh food compartment 12 is typically kept at a temperature above the freezing point of water and generally below a temperature of from about 35° F. to about 50° F., more typically below about 38° F. As shown in FIGS. 2A-3, an ice maker 20 may be located on a door 16 to the refrigerated fresh food compartment 12. The ice maker 20 may defined as an assembly of a bracket, a motor, an ice tray, a bail arm connected to the motor 24, at least one wire harness and at least one thermistor. The door 16 may include ice maker 20 and ice bin access door 46 hingedly connected to one of the doors 16 for the refrigerator 10 along the side proximate the hinge for the door 16 of the refrigerator 10 carrying the ice maker 20, i.e. the vertical edge closest to the cabinet. The hinge may be a single or multiple hinge(s) and may be spaced along the entire edge, substantially the entire edge, or more frequently two hinges may be used with one close to the top edge of the access door 46 and one close to the bottom edge of the access door 46.

Significantly, due at least in part to the access door 46 and the design and size of the ice maker 20, the access door 46 has a peripheral edge liner that extends outward from the surface of the access door 46 and defines a dike wall. The dike walls extend from at least the two vertical sides, more typically all four sides and define a door bin receiving volume along the surface of the access door 46. The access door 46 is selectively operable between an open position, in which the ice maker 20 and the ice storage container or bin 54 are accessible, and a closed position, in which the ice maker 20 and the ice storage bin 54 are not accessible. The access door 46 may also include door bins 48 that are able to hold smaller food items. The door bins 48 may also be located on or removably mounted to the access door 46 and at least partially spaced within the door bin receiving volume of the access door 46. While not typically the case, the ice maker 20 may also be located exterior the fresh food compartment 12, such as on top of the refrigerator cabinet, in a mullion between the fresh food compartment 12 and the freezer compartment 14, in a mullion between two fresh food compartments 12, or anywhere else an automatic, motor driven ice maker 20 may be located.

The refrigerator 10 may also have a duct or duct system (not shown) with an inlet in the freezer compartment 14 and an outlet in the fresh food compartment 12. The duct may be situated such that the length of the duct necessary to direct air from the freezer compartment 14 to the fresh food compartment 12 is minimized, reducing the amount of heat gained in the travel between the inlet and the outlet. The duct outlet located in fresh food compartment 12 may be positioned at a location near the ice maker 20. The refrigerator 10 may also have one or more fans, but typically has a single fan (not shown) located in the freezer compartment 14 to force air from the freezer compartment 14 to the fresh food compartment 12. The colder air from the freezer compartment 14 is needed in the ice maker 20 because air below the freezing point of water is needed to freeze the water that enters the ice maker 20 to freeze into ice cubes. In the embodiment shown, the ice maker 20 is located in the fresh food compartment 12, which typically holds air above the freezing point of water.

In various embodiments, where the ice maker 20 is located in a compartment or location other than in the freezer compartment 12, a fan is needed to force the air to the ice maker 20. In other embodiments, the fan or fans may be located either in the freezer compartment 14, the fresh food compartment 12, or in another location where the fan is able force air through the duct. The ice maker 20 is often positioned within a door of the refrigerator 10 to allow for delivery of ice through the door 16 in a dispensing area 17 on the exterior of the refrigerator 10, typically at a location on the exterior below the level of the ice storage bin 54 to allow gravity to force the ice down an ice dispensing chute into the refrigerator door 16. The chute extends from the bin to the dispensing area 17 and ice is typically pushed into the chute using an electrical power-driven auger. Ice is dispensed from the ice storage bin 54 to the user of the refrigerator 10.

The refrigerator 10 may also have a water inlet that is fastened to and in fluid communication with a household water supply of potable water. Typically, the household water supply connects to a municipal water source or a well. The water inlet may be fluidly engaged with one or more of a water filter, a water reservoir, and a refrigerator water supply line. The refrigerator water supply line may include one or more nozzles and one or more valves. The refrigerator water supply line may supply water to one or more water outlets; typically one outlet for water is in the dispensing area and another to an ice tray. The refrigerator 10 may also have a control board or controller that sends electrical signals to the one or more valves when prompted by a user that water is desired or if an ice making cycle is required.

FIG. 3 shows a closer view of a door 16 with the access door 46 in hidden lines to show the ice maker 20. The door 16 may have an inner liner 50 that is secured to an outer panel 51. The door liner 50 is disposed on an internal side of the outer panel 51 and defines an ice maker receiving space 52 in which the ice maker 20 and an ice storage bin 54 of the ice maker assembly are disposed. The ice maker receiving space 52 may be referred to a cavity or receptacle that is defined by the inner liner 50 and is configured to receive the ice storage bin 54. The ice storage bin 54 may be removably positioned within the ice maker receiving space 52 (i.e., the ice storage bin 54 may be inserted into or removed from the ice maker receiving space 52). The ice maker 20 may be located at an upper portion of the ice maker receiving space 52. The ice bin 54 may be located below the ice maker 20 such that as ice is harvested, the ice maker 20 uses gravity to transfer the ice from the ice maker 20 to the ice storage bin 54. The ice storage bin 54 may comprise an ice bin base 56 and one or more ice bin walls 58 that extends upwardly from the perimeter of the ice bin base 56.

The ice maker 20 may include an on/off switch 60. The on/off switch 60 may be located on the ice maker 20 in a location that is accessible to a user without removing the ice maker 20 from the door 16 or the refrigerator 10. The ice bin wall 58 may be configured such that when the ice storage bin 54 is placed in the door 16, the on/off switch 60 is inaccessible to the user, and when the ice storage bin 54 is removed from the door 16, the on/off switch 60 is accessible to a user. The ice storage bin wall 58 may be made of a clear plastic material such as a copolyester so that a user can see the on/off switch 60 even while inaccessible when the ice bin 54 is in place. However, the front portion of the ice bin wall 58 typically extends to cover the on/off switch 60 when in the installed position to prevent inadvertent actuation of the on/off switch 60. The front portion of the ice bin wall 58 also typically extends upward to form a lip that extends around at least a portion of the ice maker 20 to further retain ice.

The ice maker 20, the door 16 (or more specifically, the portions of the door 16 that define the ice maker receiving space 52), and the ice storage bin 54 may collectively be referred to as an ice maker assembly. The door 16 (or more specifically, the portions of the door 16 that define the ice maker receiving space 52) and the ice storage bin 54 may collectively be referred to as an ice bin assembly.

Figure 4:
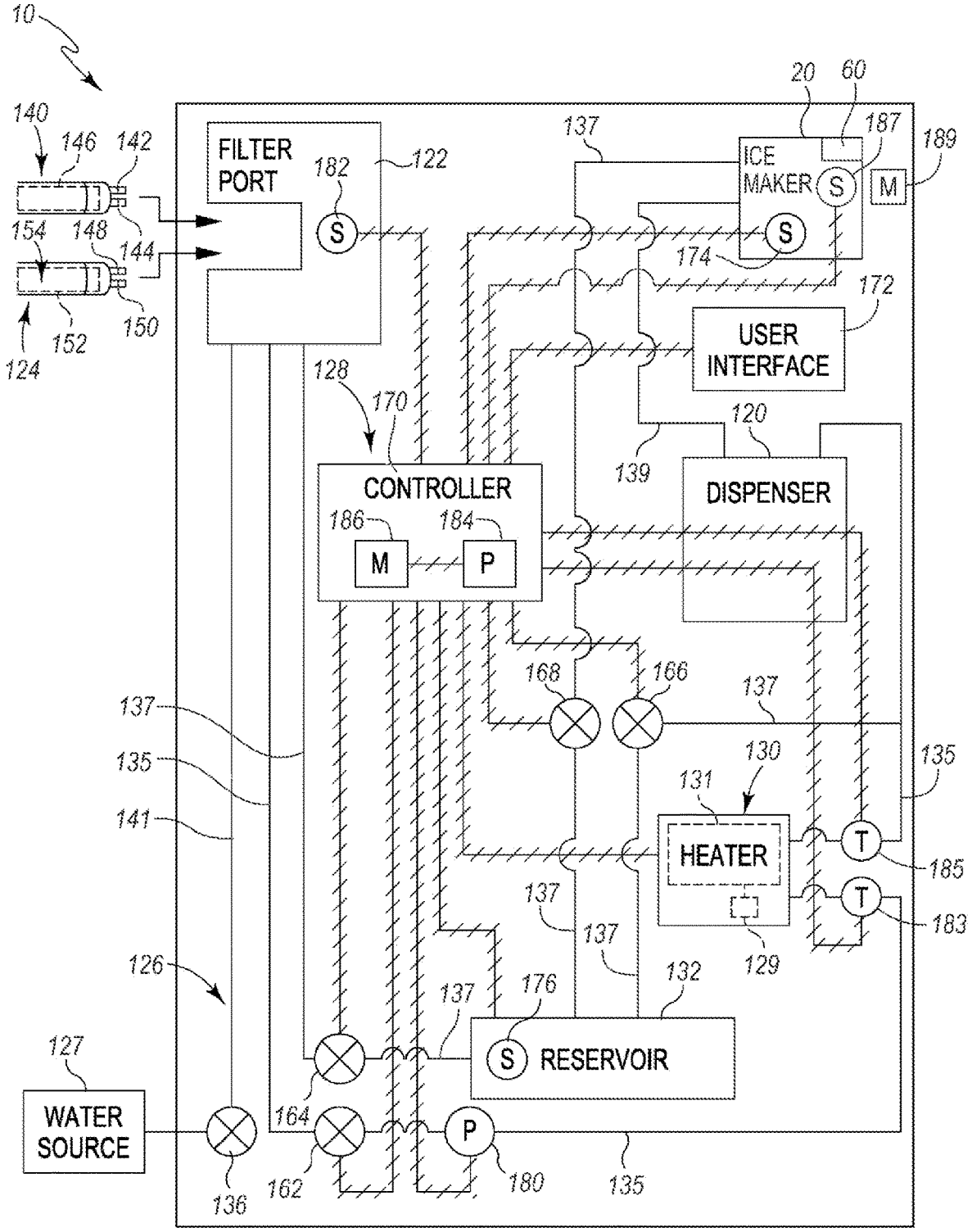
FIG. 4 is a diagrammatic view of the refrigerator appliance.
Figure 6:
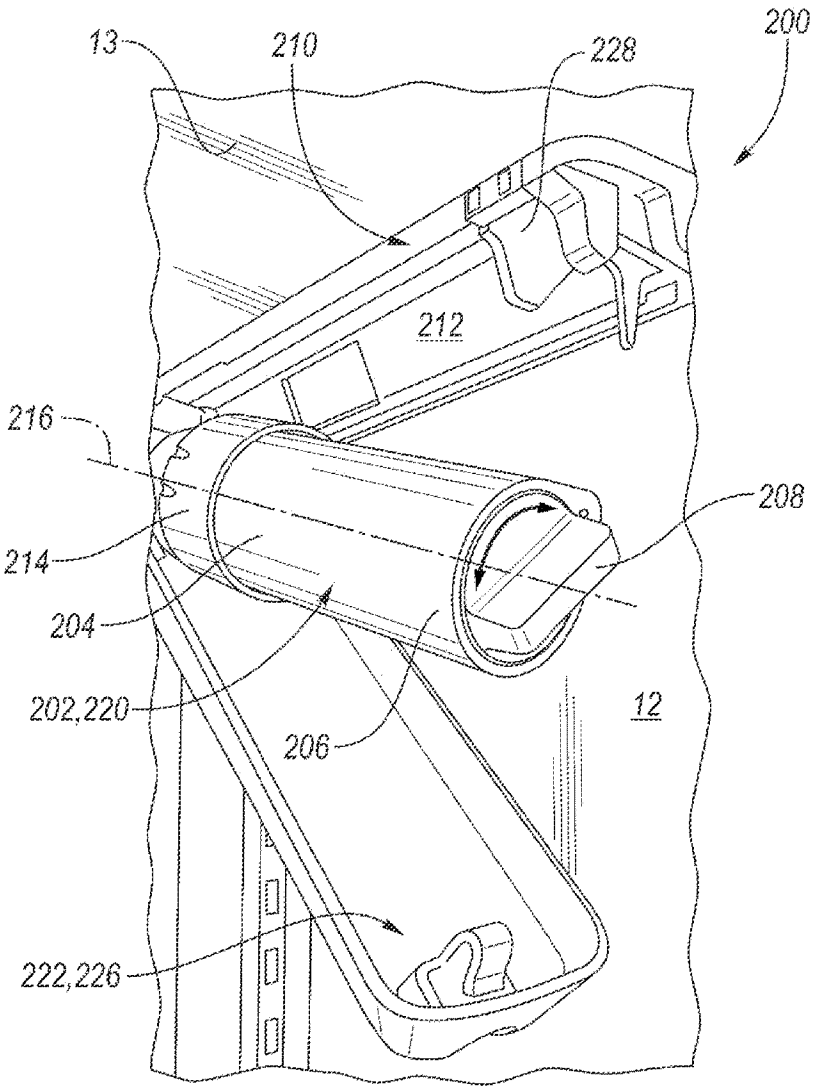
FIG. 6 is an isometric front view of the water filter assembly with (i) the water filter in a deactivated and fully engaged position and (ii) the water filter cover in the open position.
Figure 5:
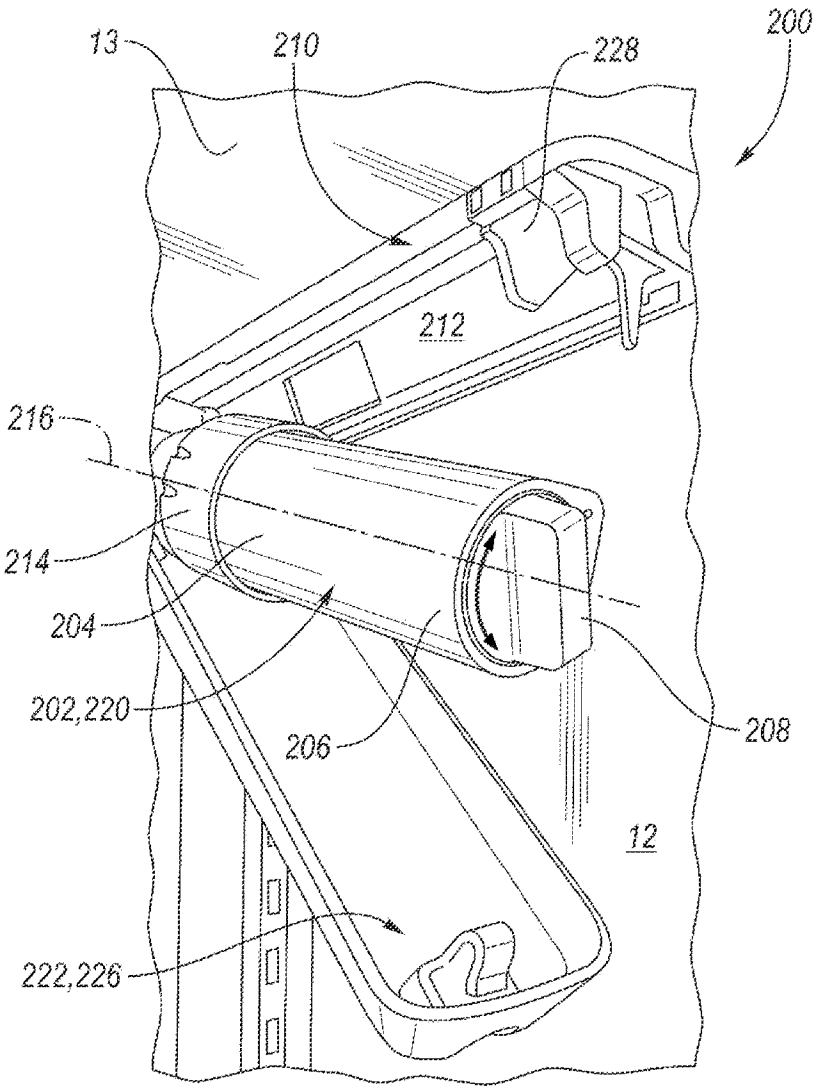
FIG. 5 is an isometric front view of a water filter assembly with (i) a water filter in a deactivated and partially engaged position and (ii) a water filter cover in an open position.
Figure 7:
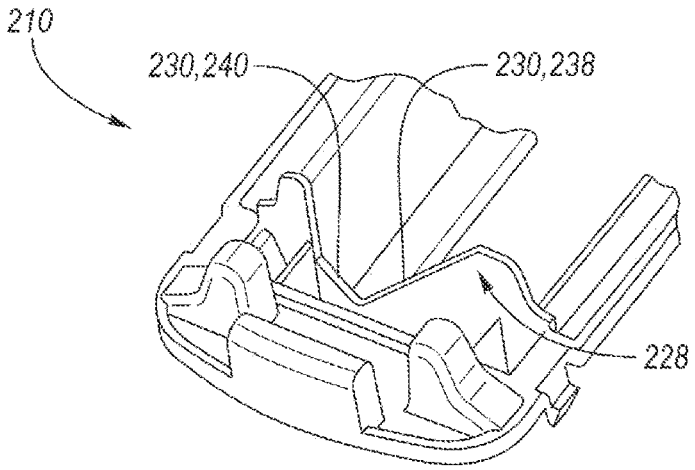
FIG. 7 is a partial bottom isometric view of a water filter receptacle.
Figure 8:
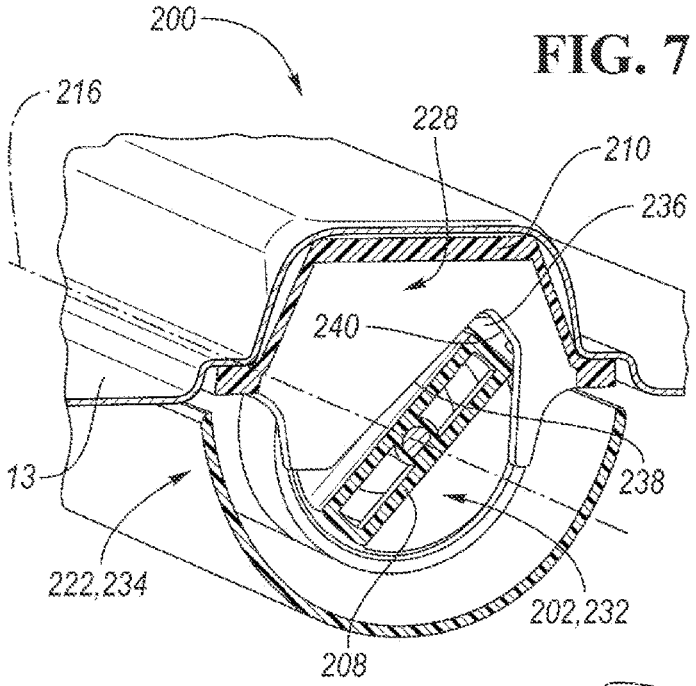
FIG. 8 is a cross-sectional isometric view of the water filter assembly with (i) the water filter in a second deactivated and partially engaged position and (ii) the water filter cover in a partially open position.
Figure 9:
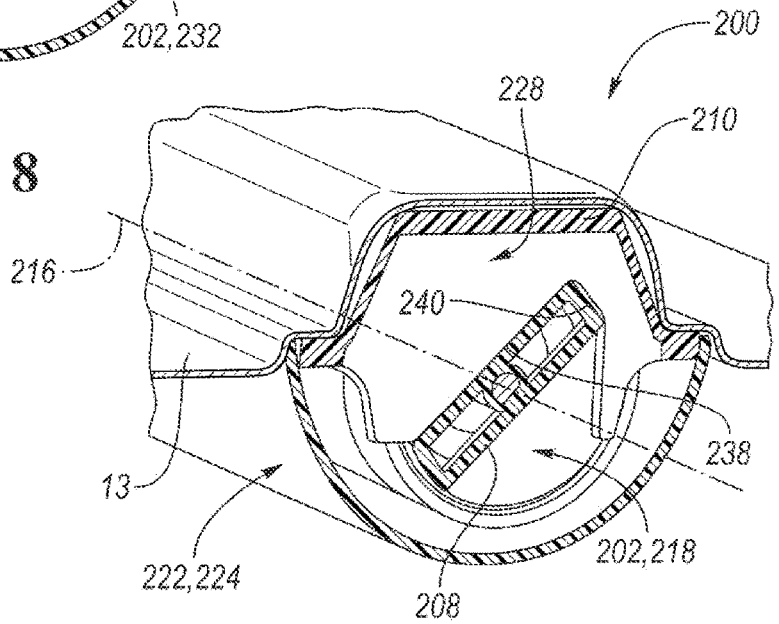
FIG. 9 is a cross-sectional isometric view of the water filter assembly with (i) the water filter in an activated and fully engaged position and (ii) the water filter cover in a closed position.
Figure 10:
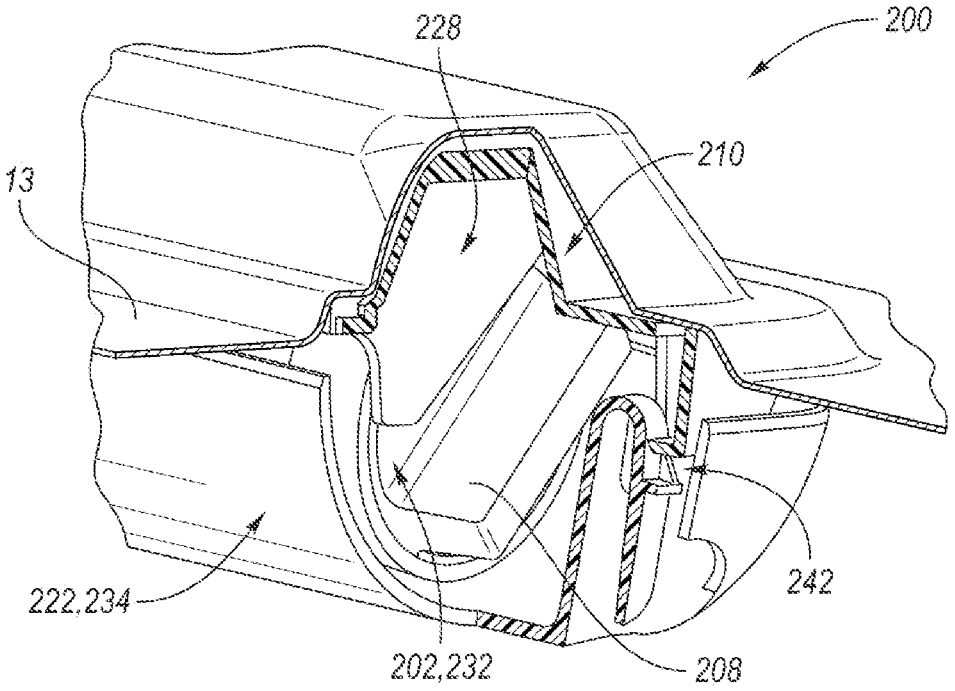
FIG. 10 is a cutout isometric view of the water filter assembly with (i) the water filter in the second deactivated and partially engaged position and (ii) the water filter cover in the partially open position.

Referring now to FIG. 4, the refrigerator 10 includes a water system 126 and a control system 128 for controlling the water system 126. The water system 126 delivers or directs water from a water source 127 to the dispenser 120 which may be located in dispensing area 17. The water system 126 also delivers or directs water from the water source 127 to the ice maker 20. The control system 128 may be operable to control the various components of the water system 126 so that the dispenser 120 dispenses cold water, hot water, or ice. The control system 128 is also operable to control the water system 126 during a pre-programmed descaling cycle or other pre-programmed cycle.

The water system 126 includes a number of components for conditioning water to be discharged through the dispenser 120. In particular, the water system may have a heating assembly 130, a cold water reservoir 132, and include ice maker 20. The heating assembly 130 includes a flow-through heating element 131 and a thermal fuse 129 configured to cut power to the flow-through heating element 131 when the flow-through heating element 131 reaches a predetermined temperature. The heating assembly 130 may be positioned between the water filter port 122 and the dispenser 120 along a hot water line 135. The cold water reservoir 132 accumulates and cools water in the refrigerator 10 prior to the water being discharged through the dispenser 120 or supplied to the ice maker 20. The cold water reservoir 132 is positioned between the water filter port 122 and the dispenser 120 along a cold water line 137. The ice maker 20 receives cold water from the cold water reservoir 132 and generates ice that is discharged through the dispenser 120 via an ice line 139.

One exemplary flow-through heating element 131 is a Ferro Flow Through Heater (FTH). The flow-through heating element 131 may positioned in the refrigerator door 16 below the dispenser 120 and outside a refrigerator insulation layer. The flow-through heating element 131 is illustratively oriented in a flat orientation so that water flows in a substantially horizontal direction through the flow-through heating element 131. In some embodiments, the flow-through heating element 131 may be a thermoblock element, a microwave element, or another suitable type of heating element. Additionally, the heating element may be positioned in another location in the door 16 or the refrigerator 10 and may be placed in a number of orientations relative thereto. In alternative embodiments of the present disclosure, the flow-through heating element 131 may be replaced or augmented by a batch heating system including a heating element and a hot water reservoir.

All the water (liquid or ice) dispensed by the refrigerator 10 may pass through the water filter port 122. The water system 126 may include a main valve 136 coupled to the water source 127 and the water filter port 122 may be coupled to the main valve 136 via a water inlet line 141. The hot water line 135 and the cold water line 137 may extend from the water filter port 122 directing water through the rest of the water system 126. The main valve 136 may be manually opened or closed to selectively allow water from the water source 127 to enter the water system 126 of the refrigerator 10.

The water filter port 122 may be configured to receive a water filter cartridge 140 or the descaling cartridge 124. The water filter cartridge 140 is illustratively consumable and discarded after use. The water filter cartridge 140 includes an inlet 142, an outlet 144, and a filter media 146 as is known in the art. In other embodiments, the water filter cartridge 140, or portions thereof, may be reusable. The descaling cartridge 124 is illustratively consumable and is charged to supply enough descaling agent 154 for one descaling cycle. In other embodiments, the descaling cartridge 124 may be refillable and/or reusable.

The descaling cartridge 124 may include an inlet 148, an outlet 150, and a descaling packet 152 containing descaling agent 154. The inlet 148 may be open to the water lines of the refrigerator 10. The descaling packet 152 may be coupled to the outlet 150 and may be squeezed by water flowing into the descaling cartridge 124 so that the descaling agent 154 is dispensed through the outlet 150 into the water lines. Water ceases to flow into the descaling cartridge 124 when the descaling cartridge 124 is full of water and the descaling packet 152 is emptied. The descaling agent 154 may then be advanced through the water system 126 and reacts with the scale built up in the water system 126 so that the scale can be flushed out of the water system 126 when the reacted descaling agent 154 is discharged through the dispenser 120. In the illustrative embodiment, the descaling agent 154 is a solution with about an 8 percent concentration of acetic acid. In other embodiments, other organic acids including but not limited to sulfonic acids or carboxylic acids, in particular, lactic acid, acetic acid, formic acid, oxalic acid, uric acid solutions may be used alone or mixtures thereof. It is also possible to use inorganic acids such as phosphoric acid, hydrochloric acid or sulfamic acid solutions. Mixtures of various inorganic and organic acids could also conceivably be used as descaling agents in accordance with embodiments of the present invention.

In other embodiments, the inlet 148 and the outlet 150 may both be open to the water lines of the refrigerator 10. In such embodiments, the descaling packet 152 may be open inside the descaling cartridge 124 or opened when water enters the descaling cartridge 124 so that water flowing through the descaling cartridge is mixed with descaling agent. The water mixing with the descaling agent 154 dilutes and carries the descaling agent through the water lines of the refrigerator 10. In some such embodiments, the descaling agent 154 may be a liquid descaling agent or a solid agent.

The water system 126 further includes a number of electronically controlled valves that can be operated to supply hot or cold water to the dispenser 120 or to supply cold water to the ice maker 20. Specifically, the water system may include a hot water valve 162, a cold water valve 164, a cold water dispenser valve 166, and an ice maker valve 168. The hot water valve 162 may be coupled between the water filter port 122 and the dispenser 120 along the hot water line 135. The cold water valve 164 may be coupled between the water filter port 122 and the dispenser 120 along the cold water line 137. The cold water dispenser valve 166 may be coupled between the cold water reservoir 132 and the dispenser 120 along the cold water line 137. The ice maker valve 168 may be coupled between the cold water reservoir 132 and the ice maker 20 along the cold water line 137.

In operation, the hot water valve 162 can be opened to advance water from the water source 127 through the heating assembly 130 to the dispenser 120. The cold water valve 164 can be opened to advance water from the water source 127 to the cold water reservoir 132. The cold water dispenser valve 166 can be opened to advance cold water from the cold water reservoir 132 to the dispenser 120. The ice maker valve 168 can be opened to advance water from the cold water reservoir 132 to the ice maker 20. Otherwise, each of the valves 162, 164, 166, 168 may be biased closed to prevent water from being advanced through the water system 126.

The control system 128 of the refrigerator 10 illustratively includes a controller 170, a user interface 172, and a number of sensors 174, 176, 180, 182, 183, 185, 187. The controller 170 is configured to operate the components of the water system 126 in response to inputs from the user interface 172 and the sensors 174, 176, 180, 182, 183, 185, 187. The user interface 172 is configured to display information and to receive user inputs. The sensors 174, 176, 180, 182, 183, 185, 187 detect information and communicate information to the controller 170.

The controller 170 includes a number of electronic components commonly associated with electronic units which are utilized in the control of electromechanical systems. For example, the controller 170 may include, amongst other components customarily included in such devices, a processor such as a microprocessor 184 and a memory device 186 such as a programmable read-only memory device ("PROM") including erasable PROM's (EPROM's or EEPROM's). The memory device 186 is provided to store, amongst other things, instructions in the form of, for example, a software routine (or routines) which, when executed by the processor, allows the controller 170 to control operation of the water system 126 and other systems included in the refrigerator 10.

The user interface 172 is illustratively coupled to the controller 170 for two way communication via a signal line as shown in FIG. 4. User interface 172 may include control buttons, paddles, and indicator lights. The buttons may be pressed to receive user inputs requesting that water dispensed be cold or hot, that ice dispensed be cubed or crushed, or that pre-programmed cycles (such as the descaling cycle) be performed by the refrigerator 10. The paddles may be pressed so that the controller 170 receives inputs requesting that water or ice be discharged by the dispenser 120. The indicator lights may be used to indicate the temperature of water to be dispensed, the type of ice to be dispensed, the status of the water filter cartridge 140, the need for a descaling cycle, the availability of one or more functions of the refrigerator 10, or other information. In some embodiments, the user interface 172 may include a graphic display, a touch screen, or other interface operable to display information and to receive user inputs.

The controller 170 is electrically coupled to each of the sensors 174, 176, 180, 182, 183, 185, 187 to receive inputs from each of the sensors 174, 176, 180, 182, 183, 185, 187 as shown in FIG. 4. In particular, the sensors 174, 176, 180, 182, 183, 185, 187 may include an ice level sensor 174, a reservoir sensor 176, temperature sensors 183, 185, a pressure sensor 180, a filter port sensor 182, and a sensor 187 to detect the presence of the ice storage bin 54 in the ice maker receiving space 52. The ice level sensor 174 is coupled to the controller 170 via a signal line and is configured to detect if the ice storage bin 54 is full. The reservoir sensor 176 is coupled to the controller 170 via a signal line and is configured to detect if the cold water reservoir 132 is full or the water level in the cold water reservoir 132. In the illustrative embodiment, water discharged through the dispenser 120 after being heated in the heating assembly 130 may be between 175-185° F., and may be typically be about 180° F. In other embodiments, water discharged through the dispenser 120 after being heated in the heating assembly 130 may be hotter or cooler. The pressure sensor 180 is coupled to the controller 170 via a signal line and is configured to detect back pressure applied to the heating assembly 130 through the hot water valve 162. In some embodiments, the hot water valve 162 may be configured to regulate the pressure being supplied to the heater assembly 130. The filter port sensor 182 is coupled to the controller 170 via a signal line and is configured to detect the presence of the water filter cartridge 140 or the descaling cartridge 124. The temperature sensors 183, 185 are coupled to the controller 170 via signal lines and are configured to monitor the temperature of water entering and exiting the heating assembly 130. If the temperature difference between the sensors 183, 185 across the heating assembly 130 is determined by the controller 170 to be outside a predetermined range, the controller 170 may disable the heating assembly 130.

Sensor 187 is coupled to the controller 170 via a signal line and is configured to detect the presence or absence of a magnet 189. The presence of the magnet 189 is indicative that the ice storage bin 54 is properly positioned in the ice maker receiving space 52 to receive ice produced by the ice maker 20. The absence of the magnet 189 is indicative that the ice storage bin 54 is not positioned, or is not properly positioned, in the ice maker receiving space 52 to receive ice produced by the ice maker 20. The sensor 187 may communicate the presence or absence of the magnet 189 to the controller 170. The controller 170 may be programmed to, in response to the sensor 187 detecting the presence of the magnet 189, initiate or allow the production of ice via the ice maker 20. The controller 170 may also be programmed to, in response to the sensor 187 detecting the absence of the magnet 189 (e.g., the sensor 187 not detecting the magnet 189), prevent the ice maker 20 from the producing of ice. The sensor 187 may be a reed switch that is configured to close a circuit when the magnetic field of the magnet 189 is detected and to open the circuit when no magnetic field is detected, or vice versa.

Additionally, the controller 170 is electrically coupled to the electrically controlled valves 162, 164, 166, 168 and the heating assembly 130 as shown in FIG. 4. Specifically, the cold water valve 164 is coupled to the controller 170 via a signal line so that the controller 170 can direct the cold water valve 164 to open or close. The hot water valve 162 is coupled to the controller 170 via a signal line so that the controller 170 can direct the hot water valve 162 to open or close. The ice maker valve 168 is coupled to the controller 170 via a signal line so that the controller 170 can direct the ice maker valve 168 to open or close. The cold water dispenser valve 166 is coupled to the controller 170 via a signal line so that the controller 170 can direct the cold water dispense valve 166 to open or close. The heating assembly 130 is coupled to the controller 170 via a signal line so that the controller 170 can direct the heating assembly 130 to activate or deactivate the flow-through heating element 131.

Hence, the control system 128 including the controller 170 may be operated to control operation of the refrigerator 10. In particular, the controller 170 executes a routine including, among other things, a control scheme in which the controller 170 monitors outputs of the sensors 180, 185 in order to inform a user of detected scale build-up and to control the availability of hot water when water system 126 contains built up scale. To do so, the controller 170 communicates with the sensors 180, 185 in order to determine, among other things, if the water system 126, (and more particularly, if the components of the hot water line 135 that conducts water for the hot water function) is likely to contain a predetermined amount of scale build-up as indicated by an elevated temperature or pressure of water flowing through the dispenser 120. In some embodiments, the controller may communicate with both temperature sensors 183, 185 and compare the temperature rise across the heating assembly 130 to determine scale build up. Armed with this data, the controller 170 determines if a descaling cycle is desirable and if continued operation of the hot water function is allowable. Once it is determined if a descaling cycle is found to be desirable, the controller 170 can direct the user interface 172 to display a request for a user to initiate the descaling cycle. If the controller 170 determines that the continued operation of the hot water function is not allowable, the controller 170 can disable the water system 126 from providing hot water to the dispenser 120.

Referring to FIGS. 5-15, a water filter assembly 200 is illustrated. The water filter assembly 200 may be secured to an interior wall within an internal cavity the refrigerator 10. More specifically, the water filter assembly 200 may be secured to one of the walls 13 of the cabinet 11 within the fresh food compartment 12. Even more specifically, the water filter assembly 200 may be secured to the upper wall 13 of the cabinet 11 within the fresh food compartment 12 (e.g., the ceiling within the fresh food compartment 12).

The water filter assembly 200 includes a water filter 202. The water filter 202 has an external housing that includes a filter media that is disposed therein. The filter media is configured to purify the water within or flowing through the water system 126. The water filter 202, or more specifically the external housing of the water filter 202, includes a distal end 204, a proximal end 206, and a protrusion or handle 208 extending therefrom. More specifically, the handle 208 may extend from the proximal end 206. The water filter assembly 200 further includes a receiver, receiving bracket, or water filter receptacle 210 that is configured to receive the water filter 202. More specifically, the water filter receptacle 210 defines and space, cavity, or chamber 212 that is configured to receive the water filter 202. The water filter receptacle 210 may be disposed within an internal cavity (e.g., the fresh food compartment 12) of the refrigerator 10. The water filter receptacle 210 may be secured to a wall 13 of the cabinet 11 within the internal cavity (e.g., the ceiling within the fresh food compartment 12).

The water filter assembly 200 includes a fluid manifold 214 that is pivotably secured to refrigerator 10. More specifically, the fluid manifold 214 may be pivotably secured to the water filter receptacle 210 and may be disposed within the chamber 212 defined by the water filter receptacle 210. The fluid manifold 214 may correspond to or include the water filter port 122. The fluid manifold 214 is configured to engage the distal end 204 of the water filter 202 via axial rotation of the water filter 202 relative to the fluid manifold 214 (e.g., along axis 216) to establish fluid communication between the water filter 202 and the water system 126. The fluid manifold 214 may engage the distal end 204 of the water filter 202 via a threaded engagement or via a rotational lock. The distal end 204 may be referred to as the opposing end of the water filter 202 relative to the handle 208. The fluid manifold 214 is also configured to (i) pivot upward to transition the water filter 202 to an activated position 218 (see FIGS. 9 and 11) and (ii) pivot downward to transition the water filter 202 to a deactivated position 220 (see FIGS. 5-6), which is desired when replacing the water filter 202. The controller 170 may detect if the water filter 202 is in the activated position 218 or deactivated position 220 via the port sensor 182. The port sensor 182 may be a proximity sensor that detects the presence or non-presence of the water filter 202 in a particular position (e.g., the activated position 218 or the deactivated position 220). If it is communicated to the controller 170 that the water filter 202 is in the activated position 218, the controller 170 may direct the water to the water filter 202. If it is communicated to the controller 170 that the water filter 202 is in the deactivated position 220, the controller 170 may isolate the water filter 202 from the remainder of the water system 126 (e.g., via a valve) or may restrict flow through the water system 126 as a whole.

The water filter assembly 200 includes a cover 222 that is pivotably secured to the refrigerator 10. More specifically, the cover 222 may be pivotably secured to the water filter receptacle 210. The cover 222 is configured to pivot upward to a closed position 224 (see FIGS. 9 and 11-12) to cover the water filter 202 within the water filter receptacle 210, or more specifically to cover the water filter 202 within the chamber 212 defined by the water filter receptacle 210. The cover 222 is also configured to pivot downward to an open position 226 (see FIGS. 5-6) to provide access to the water filter 202 within the water filter receptacle 210, or more specifically to provide access to the water filter 202 within the chamber 212 defined by the water filter receptacle 210.

The water filter assembly 200 includes a cam 228 that is disposed within the water filter receptacle 210. More specifically, the cam 228 may be secured the water filter receptacle 210 and may be disposed within the chamber 212 defined by the water filter receptacle 210. The cam 228 may also be integral to the water filter receptacle 210. The cam 228 may be in the form of a plate. The cam 228 defines a cam profile 230.

The cam 228, or more specifically the cam profile 230, is configured to interfere with the handle 208 in response to partial axial rotation of the water filter 202 relative to the fluid manifold 214 such that the water filter 202 cannot completely pivot upward to the activated position 218 and such that the cover 222 cannot completely pivot upward to the closed position 224. For example, in FIGS. 8 and 10, the water filter 202 has not been fully rotated relative to the fluid manifold 214 along axis 216 (full rotation may be required to establish fluid communication between the water filter 202 and the water system 126), resulting in an interference between the handle 208 and the cam 228, or more specifically an interference between the handle 208 and the cam profile 230, such that the water filter 202 cannot completely pivot upward to the activated position 218 and such that the cover 222 cannot completely pivot upward to the closed position 224. The position of the water filter 202 in FIGS. 8 and 10 may be referred to as a second deactivated position 232 while the position of the cover 222 in FIGS. 8 and 10 may be referred to as a partially open position 234.

The cam 228, or more specifically the cam profile 230, is configured to provide clearance for the handle 208 in response to full axial rotation of the water filter 202 relative to the fluid manifold 214 such that the water filter 202 can pivot upward to the activated position 218 and such that the cover 222 can pivot upward to the closed position 224. For example, in FIGS. 9 and 11, the water filter 202 has been fully rotated relative to the fluid manifold 214 along axis 216, resulting in the cam 228, or more specifically the cam profile 230, providing clearance for the handle 208, allowing the water filter 202 to pivot upward to the activated position 218 and allowing the cover 222 to pivot upward to the closed position 224, as shown. More specifically, the cam profile 230 defines a slot or notch 236 and the handle 208 slips into the notch 236 when the water filter 202 is fully rotated and transitioned to the activated position 218. The cam profile 230 includes a first ramped surface 238 defined along an edge of the cam 228 and a second ramped surface 240 that is also defined along an edge of the cam 228. The second ramped surface 240 intersects the first ramped surface 238. The first ramped surface 238 and the second ramped surface 240 may define the notch 236.

Figure 11:
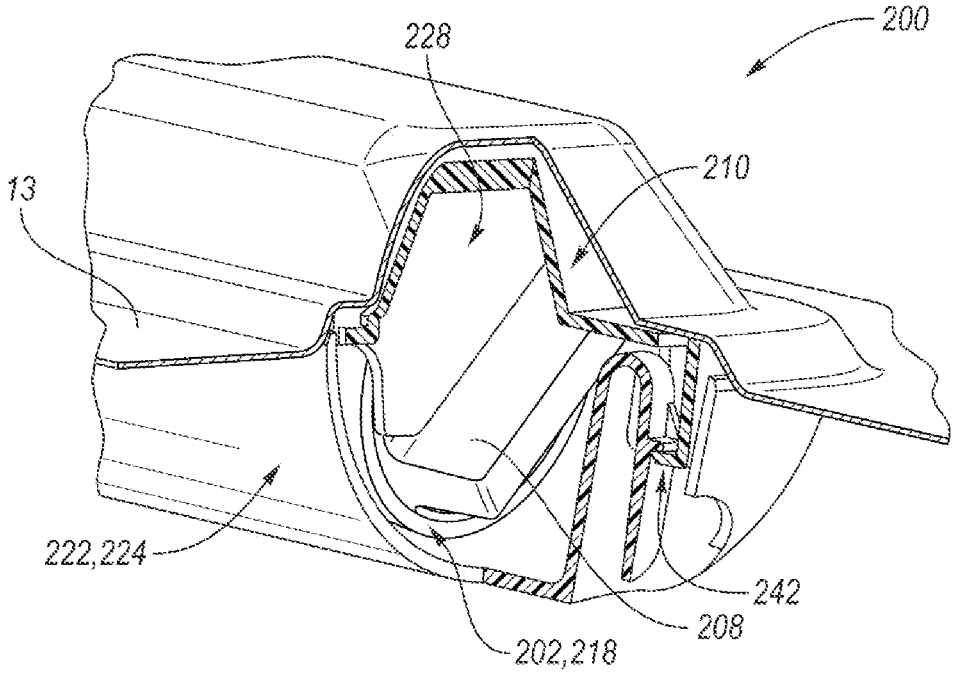
FIG. 11 is a cutout isometric view of the water filter assembly with (i) the water filter in the activated and fully engaged position and (ii) the water filter cover in the closed position.

The water filter receptacle 210 and the cover 222 may include a latch or clip 242 that engages to secure the cover 222 in the closed position 224 (see FIG. 11). However, when the cover 222 is prevented from transitioning to the closed position 224 due to the interference between the cam 228 and the handle 208, the latch or clip 242 is prevented from engaging (see FIG. 10), which provides feedback to the user that the water filter 202 is not fully rotated relative to the fluid manifold 214. This prompts the user to fully rotate the water filter 202 relative to the fluid manifold 214 so that there is no interference between the cam 228 and the handle 208 allowing the water filter 202 to then be transitioned to the activated position 218 and so that the cover 222 may then be transitioned to the closed position 224.

Figure 12:
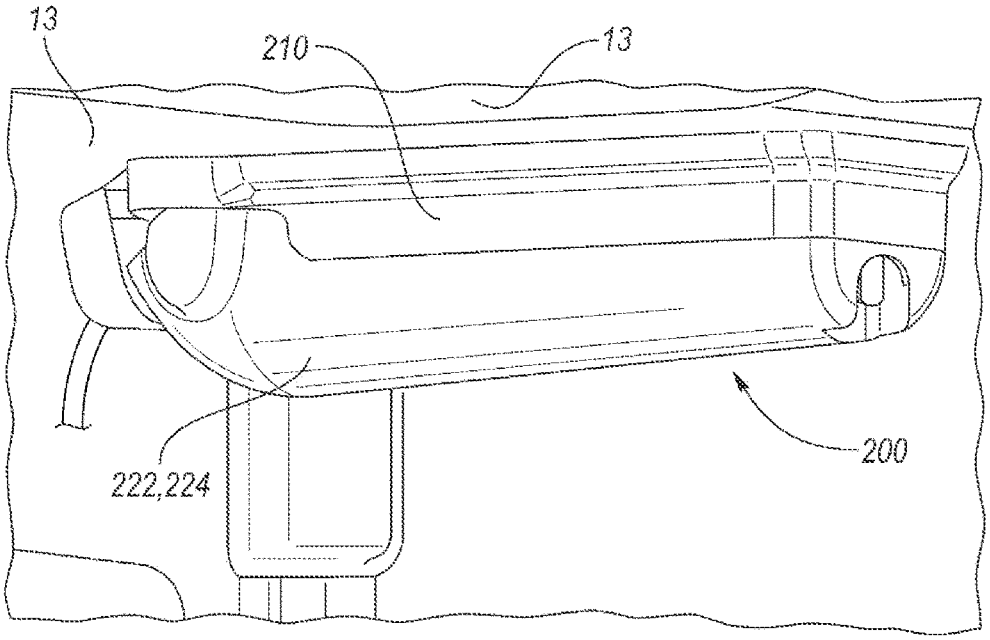
FIG. 12 is an isometric side view of the water filter assembly with (i) the water filter in the activated position and (ii) the water filter cover in the closed position.
Figure 13:
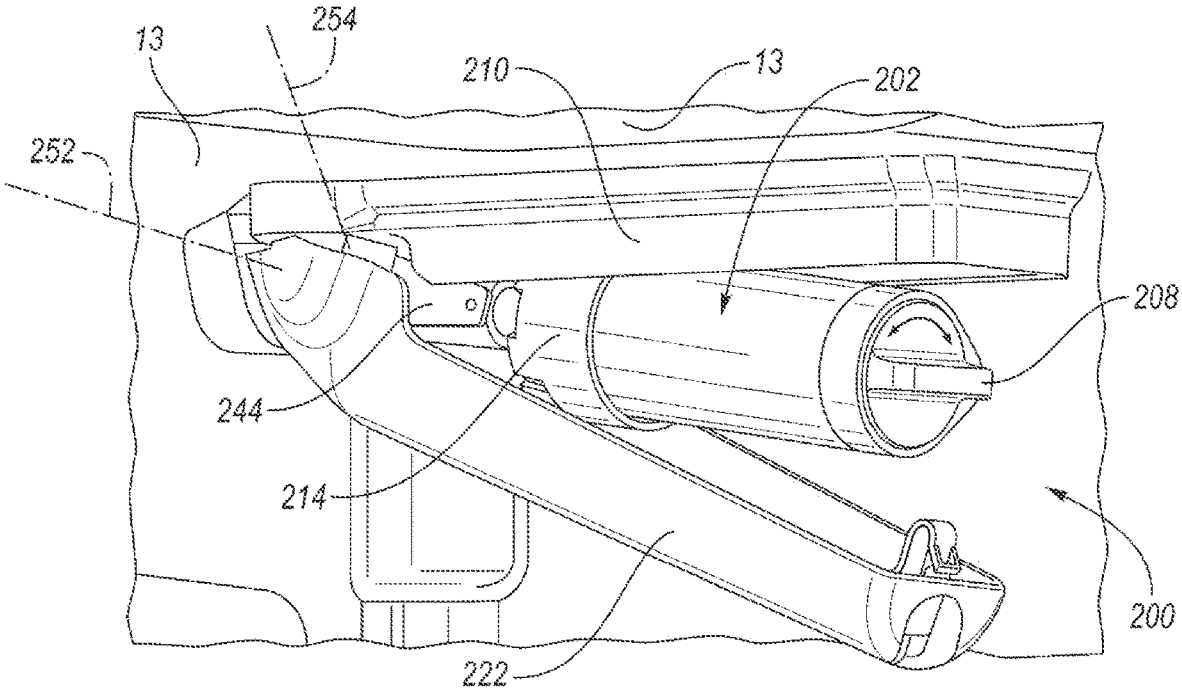
FIG. 13 is an isometric side view of the water filter assembly with (i) the water filter in the deactivated position and (ii) the water filter cover in the open position.
Figure 14:
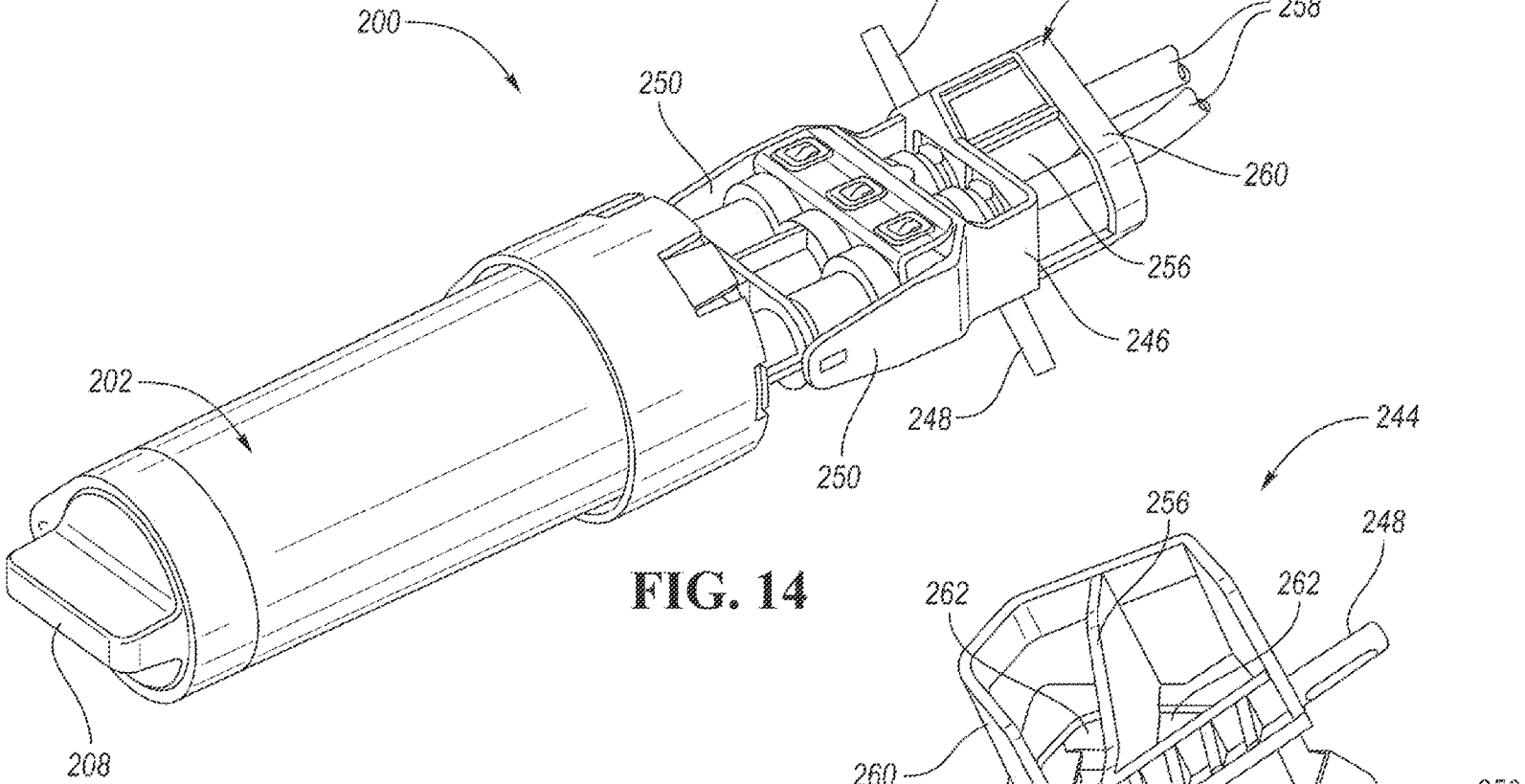
FIG. 14 is a front isometric view of the water filter assembly with the receptacle and cover removed.
Figure 15:
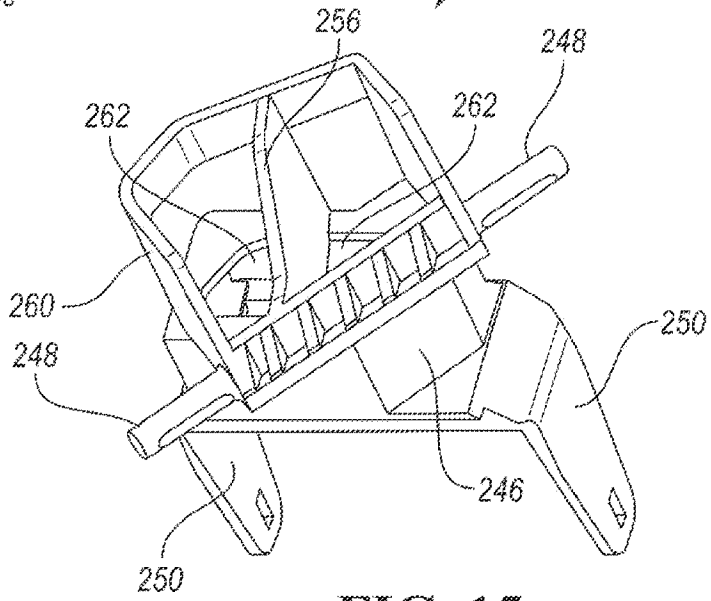
FIG. 15 is a rear isometric view of a pivot bracket that secures the water filter and a fluid manifold to the receptacle.

Referring to FIGS. 12-15, a mounting or bracketry system for mounting the water filter 202 and fluid manifold 214 to the refrigerator 10, or more specifically for mounting the water filter 202 and fluid manifold 214 to the water filter receptacle 210, is illustrated. It is noted that the filter receptacle 210 as illustrated in FIGS. 12-13 is slightly different than the filter receptacle 210 as illustrated in FIGS. 5-11. However, it should be understood that the filter receptacle 210 illustrated in FIGS. 12-13 may be interchangeable with the water filter receptacle 210 as illustrated in FIGS. 5-11. The mounting or bracketry system includes a pivot bracket 244 that pivotably secures the fluid manifold 214 to the refrigerator 10, or more specifically pivotably secures the fluid manifold 214 to the water filter receptacle 210. The pivot bracket 244 includes a main body 246, one or more pivots or posts 248 that protrude outward from the main body 246, and a pair of arms 250 that protrude forward from the main body 246. The pivots or posts 248 are disposed within orifices defined by the water filter receptacle 210 or bushings disposed within the water filter receptacle 210 such that the pivot bracket 244 may rotate relative the orifices or bushings. The fluid manifold 214 is secured to the arms 250 and the water filter 202 in turn may be secured to the fluid manifold 214. The water filter 202, fluid manifold 214, and pivot bracket 244 may collectively rotate about the pivots or posts 248 to transition the water filter 202 between the activated position 218 and the deactivated position 220.

The cover 222 is configured to pivot about a substantially horizontal axis 252. Substantially horizontal may refer to any incremental angle that is between exactly horizontal and 15° from exactly horizontal. The pivot bracket 244 is configured to pivot about a secondary axis 254 that is radially offset from the substantially horizontal axis 252. More specifically, the secondary axis 254 may be offset from the substantially horizontal axis 252 by an angle that is substantially 45°. Substantially 45° may refer to any incremental angle that is between exactly 45° and 5° from exactly 45°.

The pivot bracket 244 includes a divider plate 256 that separates water lines 258 that are routed to the fluid manifold 214. The pivot bracket 244 also includes a cage 260 that surrounds the water lines 258 that are routed to the fluid manifold 214. The pivot bracket defines orifices 262 for routing the water lines 258 to the fluid manifold 214, allowing the water lines 258 to be connected to the fluid manifold 214. The divider plate 256 and the cage 260 operate to route, divide, surround, and provide protection for the water lines 258. The divider plate 256 and the cage 260 further operate to prevent binding of the water lines 258.

It should be understood that the designations of first, second, third, fourth, etc. for any component, state, or condition described herein may be rearranged in the claims so that they are in chronological order with respect to the claims. Furthermore, it should be understood that any component, state, or condition described herein that does not have a numerical designation may be given a designation of first, second, third, fourth, etc. in the claims if one or more of the specific component, state, or condition are claimed.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A refrigerator comprising:

a cabinet defining an internal cavity configured to receive foodstuffs:

a water system configured to deliver water from a source to a dispenser and an ice maker;

a water filter configured to purify the water within the water system, the water filter having (i) a distal end, (ii) a proximal end, and (iii) a handle extending from the proximal end;

a receptacle (i) disposed within the internal cavity and (ii) configured to receive the water filter;

a fluid manifold (i) pivotably secured to the receptacle, (ii) configured to engage the distal end of the water filter via axial rotation of the water filter relative to the fluid manifold to establish fluid communication between the water filter and the water system, and (iii) configured to pivot upward to transition the water filter to an activated position, and (iv) configured to pivot downward to transition the water filter to a deactivated position for replacement;

a cover (i) pivotably secured to the receptacle, (ii) configured to pivot upward to a closed position to cover the water filter within the receptacle, and (iii) configured to pivot downward to an open position to provide access to the water filter within the receptacle; and a plate (i) disposed within the receptacle, (ii) defining a cam profile, wherein the cam profile is configured to (a) interfere with the handle in response to partial axial rotation of the water filter relative to the fluid manifold such that the water filter cannot pivot upward to the activated position and such that the cover cannot pivot upward to the closed position and (b) provide clearance for the handle in response to full axial rotation of the water filter relative to the fluid manifold such that the water filter can pivot upward to the activated position and such that the cover can pivot upward to the closed position.

2. The refrigerator of claim 1, wherein the cam profile includes a ramped surface defined along an edge of the plate.

3. The refrigerator of claim 2, wherein the cam profile includes a second ramped surface defined along the edge of the plate that intersects the ramped surface.

4. The refrigerator of claim 1 further comprising a pivot bracket that pivotably secures the fluid manifold to the receptacle.

5. The refrigerator of claim 4, wherein (i) the cover is configured to pivot about a substantially horizontal axis and (ii) the pivot bracket is configured to pivot about and a secondary axis that is radially offset from the substantially horizontal axis.

6. The refrigerator of claim 5, wherein the secondary axis is radially offset from the substantially horizontal axis by an angle that is substantially 45°.

7. The refrigerator of claim 4, wherein the pivot bracket includes a divider plate that separates water lines that are routed to the fluid manifold.

8. The refrigerator of claim 4, wherein the pivot bracket includes a cage that surrounds water lines that are routed to the fluid manifold.

9. A refrigerator comprising:

a filter housing having a handle extending therefrom;

a receptacle configured to receive the filter housing;

a fluid manifold configured to (i) engage an opposing end of the filter housing relative to the handle via axial rotation of the filter housing relative to the fluid manifold, (ii) pivot upward within the receptacle to transition the filter housing to an activated position, and (iii) pivot downward within the receptacle to transition the filter housing to a deactivated position;

a cover configured to (i) pivot upward to a closed position to cover the filter housing within the receptacle, and (ii) to pivot downward to an open position to provide access to the filter housing within the receptacle; and a cam plate (i) disposed within the receptacle, (ii) configured to interfere with the handle in response to partial axial rotation of the filter housing relative to the fluid manifold such that the filter housing cannot pivot upward to the activated position and such that the cover cannot pivot upward to the closed position, and (iii) configured to provide clearance for the handle in response to full axial rotation of the filter housing relative to the fluid manifold such that the filter housing can pivot upward to the activated position and such that the cover can pivot upward to the closed position.

10. The refrigerator of claim 9, wherein the cam plate includes a ramped surface defined along an edge of the cam plate.

11. The refrigerator of claim 10, wherein the cam plate includes a second ramped surface defined along the edge of the cam plate that intersects the ramped surface.

12. The refrigerator of claim 9 further comprising a pivot bracket that pivotably secures the fluid manifold to the receptacle.

13. The refrigerator of claim 12, wherein (i) the cover is configured to pivot about a substantially horizontal axis and (ii) the pivot bracket is configured to pivot about and a secondary axis that is radially offset from the substantially horizontal axis.

14. The refrigerator of claim 12, wherein the pivot bracket includes a divider plate that separates water lines that are routed to the fluid manifold.

15. A refrigerator comprising:

a filter having a protrusion extending therefrom;

a receiver defining a cavity configured to receive the filter;

a manifold configured to (i) engage an opposing end of the filter relative to the protrusion via axial rotation of the filter relative to the manifold, (ii) pivot upward within the cavity to transition the filter to an activated position, and (iii) pivot downward within the cavity to transition the filter to a deactivated position; and a cam (i) disposed within the cavity, (ii) configured to interfere with the protrusion in response to partial axial rotation of the filter relative to the manifold to prevent the filter from pivoting upward to the activated position, and (iii) configured to provide clearance for the protrusion in response to full axial rotation of the filter relative to the manifold to facilitate the filter pivoting upward to the activated position.

16. The refrigerator of claim 15 further comprising a cover configured to (i) pivot upward to a closed position to cover the filter within the cavity and (ii) to pivot downward to an open position to provide access to the filter within the cavity.

17. The refrigerator of claim 16, wherein (i) interference between the cam and the protrusion prevents the cover from pivoting upward to the closed position and (ii) non-interference between the cam and the protrusion enables the cover to pivot upward to the closed position.

18. The refrigerator of claim 15, wherein the cam includes a ramped surface defined along an edge of the cam.

19. The refrigerator of claim 18, wherein the cam includes a second ramped surface defined along the edge of the cam that intersects the ramped surface.

20. The refrigerator of claim 15 further comprising a pivot bracket that pivotably secures the manifold the cavity.

* * * * *